US008381321B2

(12) United States Patent
Nishizaki et al.

(10) Patent No.: US 8,381,321 B2
(45) Date of Patent: Feb. 26, 2013

(54) TOILET APPARATUS

(75) Inventors: Yoshihiro Nishizaki, Osaka (JP); Takahiro Nakamura, Osaka (JP); Kenjirou Arashi, Kyoto (JP)

(73) Assignee: Panasonic Corporation, Kadoma-shi (JP)

( * ) Notice: Subject to any disclaimer, the term of this patent is extended or adjusted under 35 U.S.C. 154(b) by 271 days.

(21) Appl. No.: 12/311,658

(22) PCT Filed: Oct. 15, 2007

(86) PCT No.: PCT/JP2007/070105

§ 371 (c)(1),
(2), (4) Date: Apr. 8, 2009

(87) PCT Pub. No.: WO2008/044791

PCT Pub. Date: Apr. 17, 2008

(65) Prior Publication Data

US 2010/0017949 A1 Jan. 28, 2010

(30) Foreign Application Priority Data

Oct. 13, 2006 (JP) ..... 2006-280671
Nov. 30, 2006 (JP) ..... 2006-324589

(51) Int. Cl.
*E03D 9/02* (2006.01)

(52) U.S. Cl. ..... 4/223

(58) Field of Classification Search ..... 4/222, 223, 4/224, 420, 431, 432, 300, 232; 222/318
See application file for complete search history.

(56) References Cited

U.S. PATENT DOCUMENTS 4,924,532 A * 5/1990 Pennestri ..... 4/233
6,256,802 B1 * 7/2001 Stradinger ..... 4/432
7,025,234 B2 * 4/2006 Priebe et al. ..... 222/400.7
7,316,038 B2 * 1/2008 Egeresi ..... 4/420.4

FOREIGN PATENT DOCUMENTS

JP 02-305529 12/1990
JP 08-105095 4/1996
JP 10-159152 A 6/1998
JP 2000-001892 1/2000

(Continued)

OTHER PUBLICATIONS

Notification of Reasons for Refusal mailed Jul. 8, 2008, issued on corresponding/relevant application and the English translation thereof.

(Continued)

*Primary Examiner* — Gregory Huson
*Assistant Examiner* — Janie Christiansen
(74) *Attorney, Agent, or Firm* — Edwards Wildman Palmer LLP

(57) ABSTRACT

A toilet apparatus includes a bowl cleaning unit for mixing a detergent that removes dirt on the inner walls of the bowl with cleaning water which is to be flushed into the bowl. The detergent is stored in a detergent tank which is provided inside a housing forming the outer shell of the toilet apparatus, and is supplied to the water supply channel of the cleaning water from the detergent tank through a detergent supply unit. The detergent tank is accommodated in an internal space of the housing and is concealed inside the housing behind a detachable cover which constitutes a portion of the outer walls of the housing.

9 Claims, 12 Drawing Sheets

FOREIGN PATENT DOCUMENTS

| | | | |
|---|---|---|---|
| JP | 2000-045365 | | 2/2000 |
| JP | 2000-064394 | | 2/2000 |
| JP | 2000-287868 | A | 10/2000 |
| JP | 2002-097704 | | 5/2002 |
| JP | 2003-500579 | | 1/2003 |
| JP | 2003-160965 | A | 6/2003 |
| JP | 2003-247259 | | 9/2003 |
| JP | 2003-278219 | | 10/2003 |
| JP | 2004-100331 | A | 4/2004 |
| JP | 2005-273210 | | 10/2005 |

OTHER PUBLICATIONS

International Search Report dated Nov. 20, 2007, issued on PCT/JP2007/070105.

Office Action mailed Jan. 17, 2012, issued for the Japanese Patent Application No. 2008-538782.

Korean Office Action for Korean Application No. 10-2009-7009042 issued Mar. 11, 2011.

* cited by examiner

TOILET APPARATUS

TECHNICAL FIELD

The present invention relates to a toilet apparatus provided with a bowl washing unit which sprays a detergent into the bowl.

BACKGROUND ART

Japanese Patent Application Publication No. 2003-247259 discloses a toilet apparatus provided with a private part washing device for cleaning a specific portion, which comprises, in addition to a cleaning nozzle that sprays water for cleaning the local part, a detergent nozzle which sprays a detergent solution for cleaning the actual cleaning nozzle, and a bowl cleaning nozzle which sprays the detergent solution onto the inner surface of the bowl in order to clean the inner surface of the bowl. These nozzles are connected to a common water supply channel which is connected to a water source and are operated selectively according to requirements. This water supply channel is composed in such a manner that water from the water source is supplied to the cleaning nozzle, a cleaning tank containing detergent is connected to an intermediate point of the water supply channel, and when the detergent nozzle or bowl cleaning nozzle is operated, detergent is expelled into the supply channel and mixed with the water to create a detergent solution. This water supply channel is formed independently from a main water supply channel for supplying cleaning water for expelling dirt from the bowl, and carries a small amount of water in comparison with the main water supply channel. Furthermore, the amount of detergent used is also small and therefore it is possible to make the detergent tank small in size, in such a manner that it does not detract from the external appearance of the toilet apparatus, wherever it may be disposed inside or outside the toilet apparatus.

DISCLOSURE OF THE INVENTION

In order to clean away dirt which is covering a large surface area of the inner wall of a toilet bowl, it is not sufficient simply to spray a detergent solution from a bowl cleaning nozzle as described in the prior art technology, and it is required to mix detergent into a large volume of cleaning water flowing from the main water supply channel and to expel cleaning solution onto the whole of the bowl. In this case, it is necessary to use a large volume of detergent, requiring a large size of the detergent tank, and thus the location of the detergent tank must be devised appropriately. When the tank is disposed outside the toilet apparatus, it will detract from its external appearance.

The present invention is devised in view of the problems of the prior art described above, and has an object to provide a toilet apparatus having a good external appearance in which a detergent tank storing therein detergent is not exposed from the exterior of the toilet, as well as being able to clean the whole of the inner surface of the bowl efficiently.

The toilet apparatus relating to the present invention includes a toilet having a bowl and a housing that surrounds the bowl, and a bowl cleaning unit which flushes cleaning water for cleaning the interior of the bowl. The bowl cleaning unit includes: a water supply channel which guides pressurized cleaning water supplied from an external water supply source into the bowl; a detergent tank which stores a detergent for removing dirt on inner walls of the bowl; and a detergent supply means for supplying the detergent into the water supply channel from the detergent tank and mixing the detergent into the cleaning water. The detergent tank is disposed in a space inside the housing, and a portion constituting outer walls of the housing forms a cover that is detachable from other portions of the outer walls to conceal therebehind the detergent tank within the housing. This configuration is designed to mix the detergent into the cleaning water for expelling dirt inside the toilet, enabling to efficiently clean the inner walls of the bowl by the use of this cleaning water flushing over the whole surface of the inner walls of the bowl. This configuration is also enabled to improve the external appearance of the toilet apparatus by concealing the detergent tank within the toilet. In this configuration, the cover is arranged to be removable from the toilet, making it easy to carry out maintenance of the toilet apparatus such as a supply of detergent into the detergent tank.

Preferably, the detergent tank described above is detachable from the toilet. In this configuration, it is possible to remove the detergent tank from the toilet for making it easy to supply the detergent into the detergent tank.

The detergent supply means described above has a detergent supply channel through which the detergent tank is connected to the water supply channel. The bowl cleaning unit is provided in its water supply channel with an electromagnetic valve. When being opened, the electromagnetic valve flows the cleaning water in the water supply channel, thereby developing a negative pressure for sucking up the detergent from within the detergent tank into the water supply channel through the detergent supply channel, so as to flush the cleaning water containing the detergent into the bowl. In this configuration, the detergent tank is formed with a pipe for supplying the detergent, and this pipe of the detergent tank is detachable to a tube forming the detergent supply channel, and thereby only the detergent tank can be removed outward from the bowl cleaning unit which is disposed inside the toilet.

More preferably, the detergent supply channel is provided with a pump for supplying the detergent into the water supply channel. When being opened, the electromagnetic valve flows the cleaning water into the water supply channel in this configuration, thereby allowing the detergent to be supplied to the water supply channel from within the detergent tank through the detergent supply channel by an action of the pump. In this configuration, the detergent is reliably mixed into the cleaning water flowing in the water supply channel.

More preferably, the water supply channel is formed at its downstream end with a flushing port which opens circumferentially along the upper perimeter of the bowl. This configuration is enabled to flow the cleaning water containing the detergent from the water supply channel, and to generate a spiral downward flow of the cleaning water containing the detergent over the inner wall surfaces of the bowl, and thereby efficiently cleaning the inner wall surfaces of the bowl.

In the toilet apparatus according to the present invention, the water supply channel is preferably connected to an air intake channel for introducing external air. This configuration is enabled to mix air bubbles into the cleaning water containing detergent, thereby further improving the bowl cleaning effect.

BEST MODE FOR CARRYING OUT THE INVENTION

Hereafter, the present invention is described on the basis of an embodiment which is shown in the accompanying drawings. As described in FIGS. 1 and 3, the toilet apparatus in the present embodiment comprises a bowl 10, a rim 90 which is joined to an upper edge of an opening of the bowl 10, and a housing 20 which surrounds outer perimeters of the bowl and the housing. The housing 20 forms an outer shell of the toilet. The toilet is fixed to a metal supporting frame 1 which is installed on the floor. The bowl 10, the rim 90 and the housing 20 are molded from a synthetic resin such as methacrylic resin, and respectively welded together to form a toilet with substantially seamless external appearance. In this conformation, the housing 20 has a large space for accommodating therein the various attachments, especially at a rear portion of the bowl 10. The rim 90 can be molded with the housing 20 or the bowl 10 to form a unified body.

Figure 7:
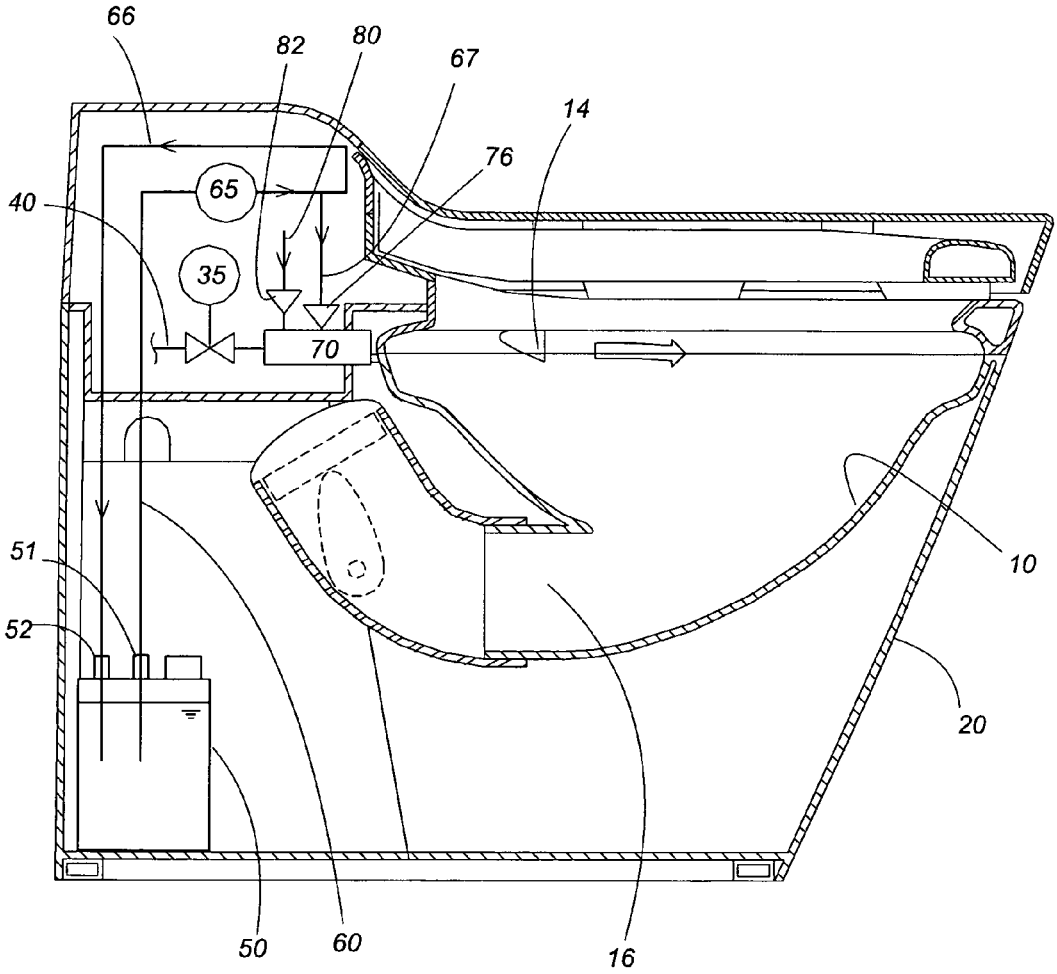
FIG. 7 is an approximate cross-sectional diagram showing the internal structure of the above toilet apparatus.
Figure 10:
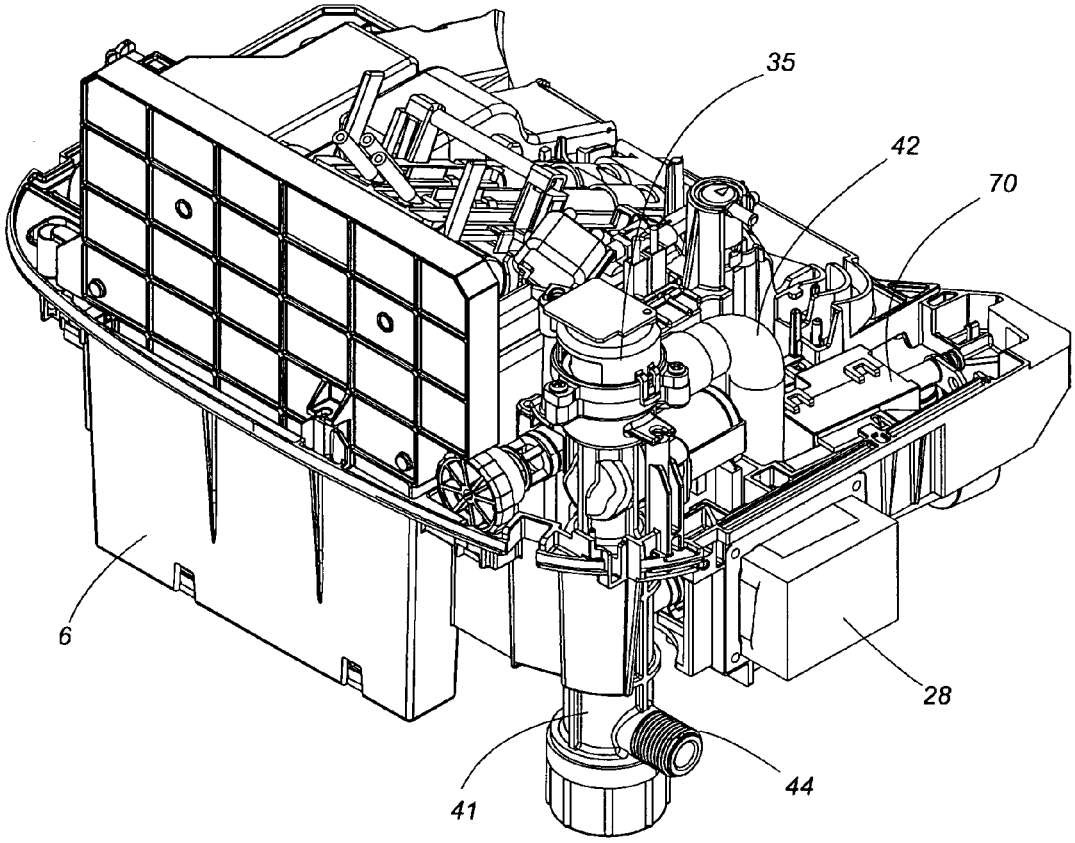
FIG. 10 is a perspective diagram showing one portion of the bowl cleaning unit used in the above toilet apparatus.

The housing 20 accommodates therein a bowl cleaning unit 30 which flows cleaning water into the bowl 10, at a rear portion of the toilet. As shown in FIGS. 7 and 10, this bowl cleaning unit 30 comprises a water supply channel 40 which guides externally supplied pressurized cleaning water into the bowl 10, and an electromagnetic valve 35 which is provided in the water supply channel 40. The water supply channel 40 is formed as a duct. The water supply channel is provided at its one end with a water supply port 43 connected to an external water supply source, and is connected at the other end to a connection port 12 formed on the upper end of the bowl 10. Upon being driven by a cleaning button 28 pressed by a user of the toilet, the electromagnetic valve 35 opens so as to cause pressurized water from the supply source to flush into the bowl 10 through a flushing port 14 formed along the upper inside peripheral end of the bows 10, thereby expelling dirt on the interior of the toilet out through a discharge opening 16 in the lower end of the bowl 10.

Figure 3:
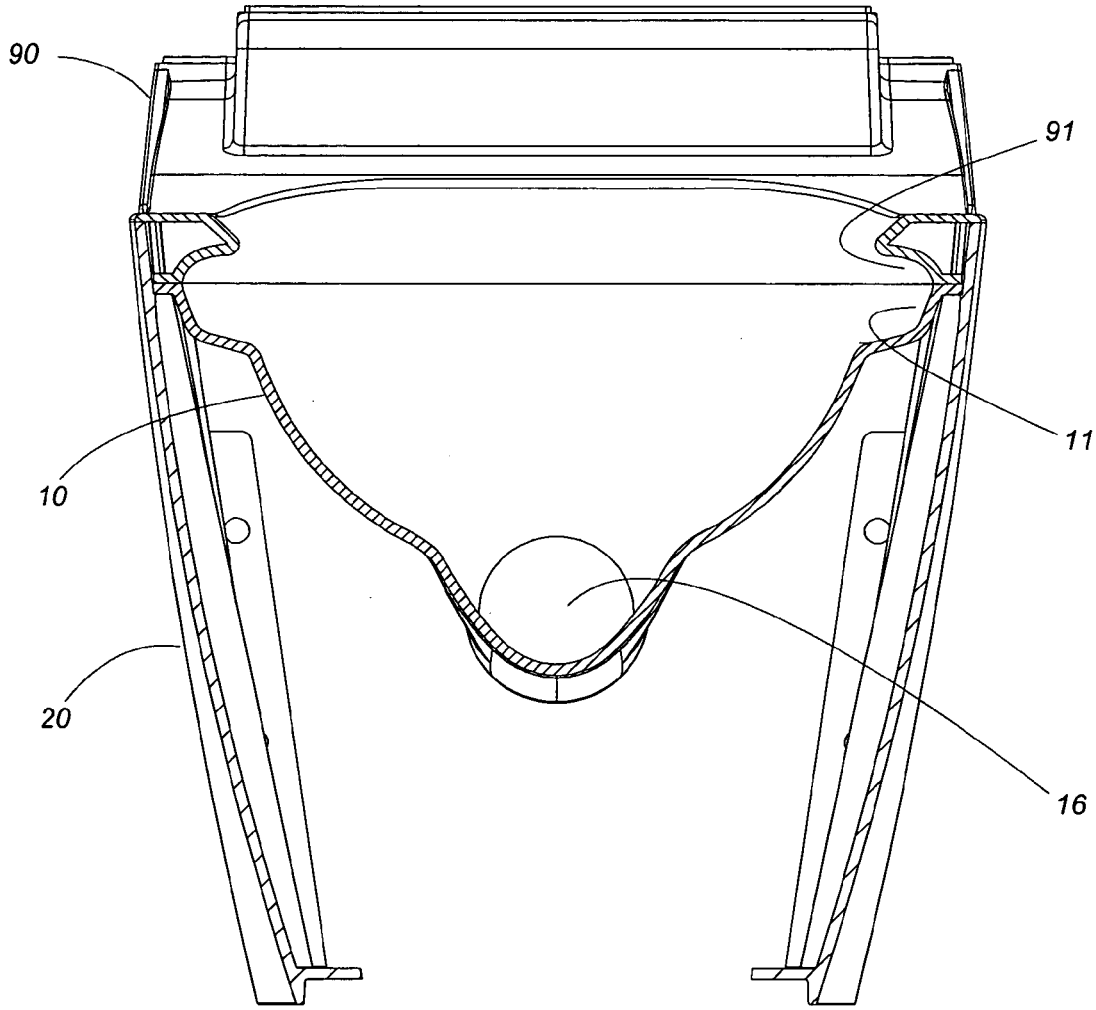
FIG. 3 is a cross-sectional diagram showing one portion of the above toilet apparatus.
Figure 4:
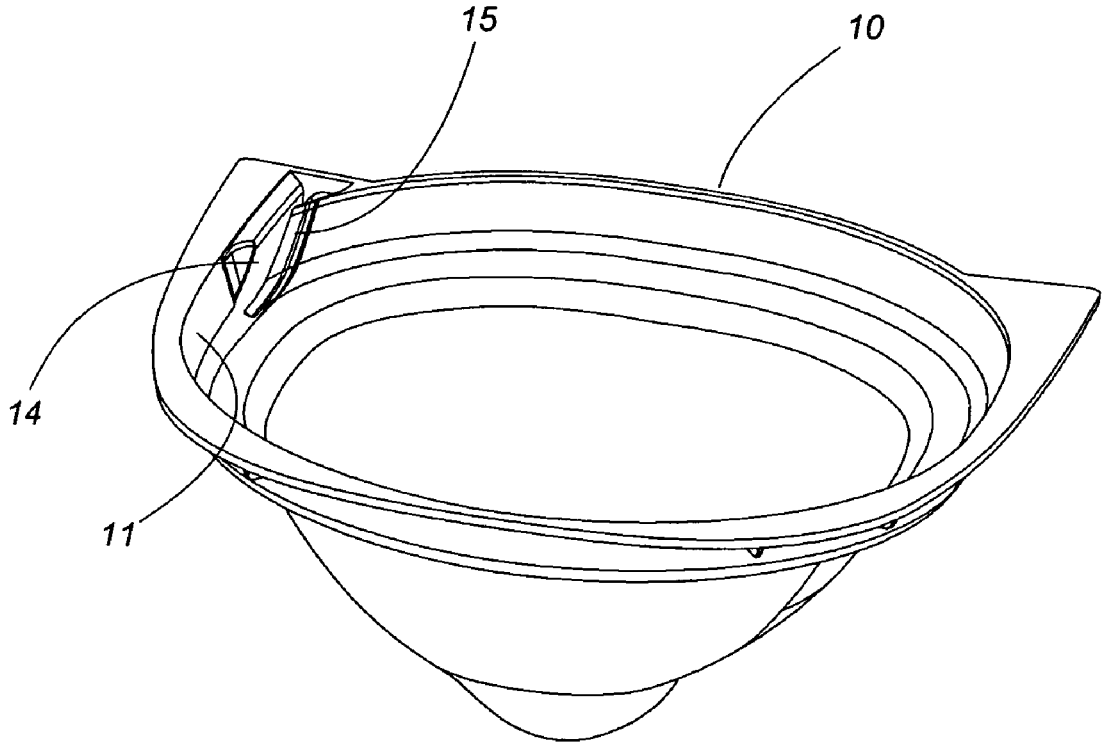
FIG. 4 is a plan diagram showing the bowl of the above toilet apparatus.
Figure 5:
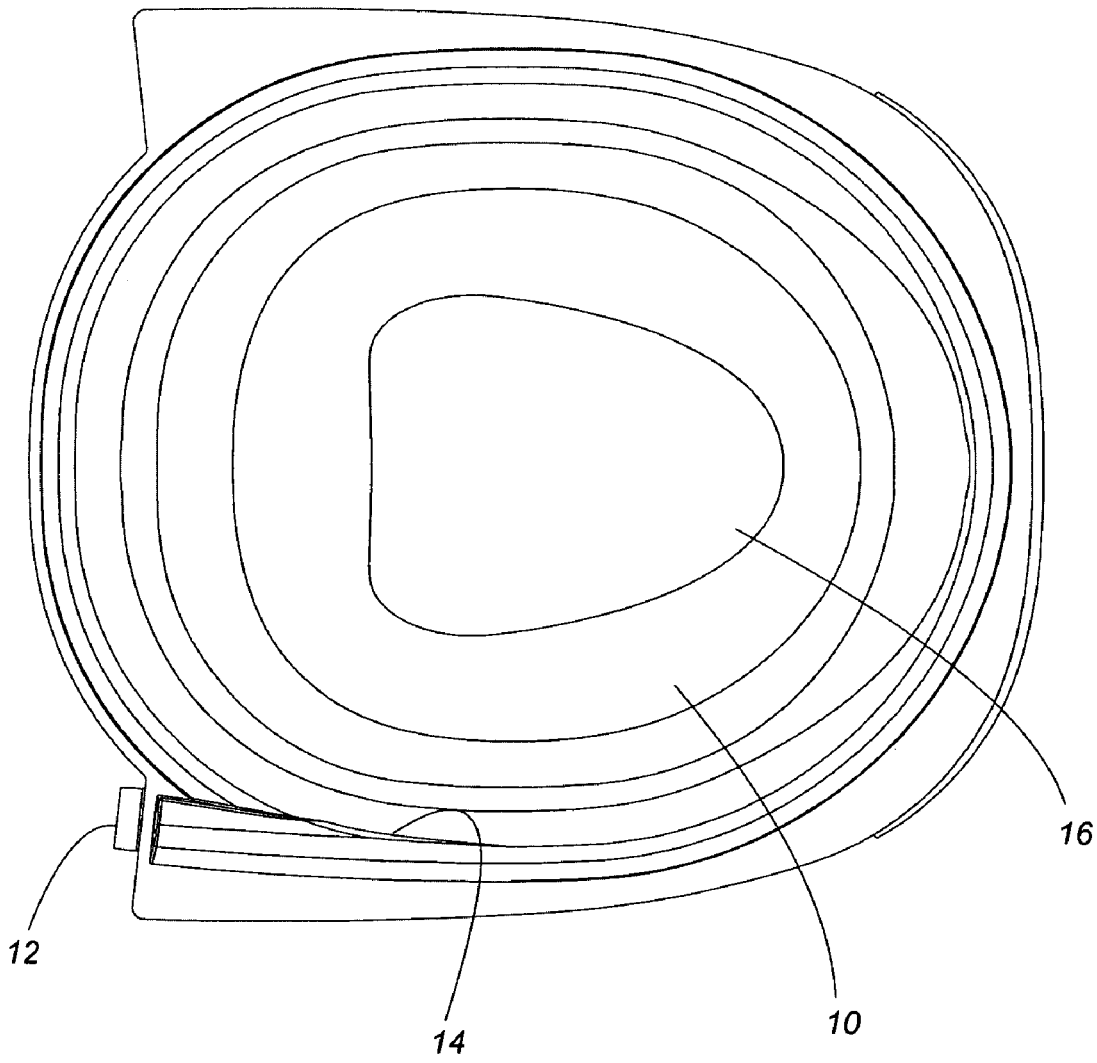
FIG. 5 is a plan diagram showing the bowl of the above toilet apparatus.
Figure 6:
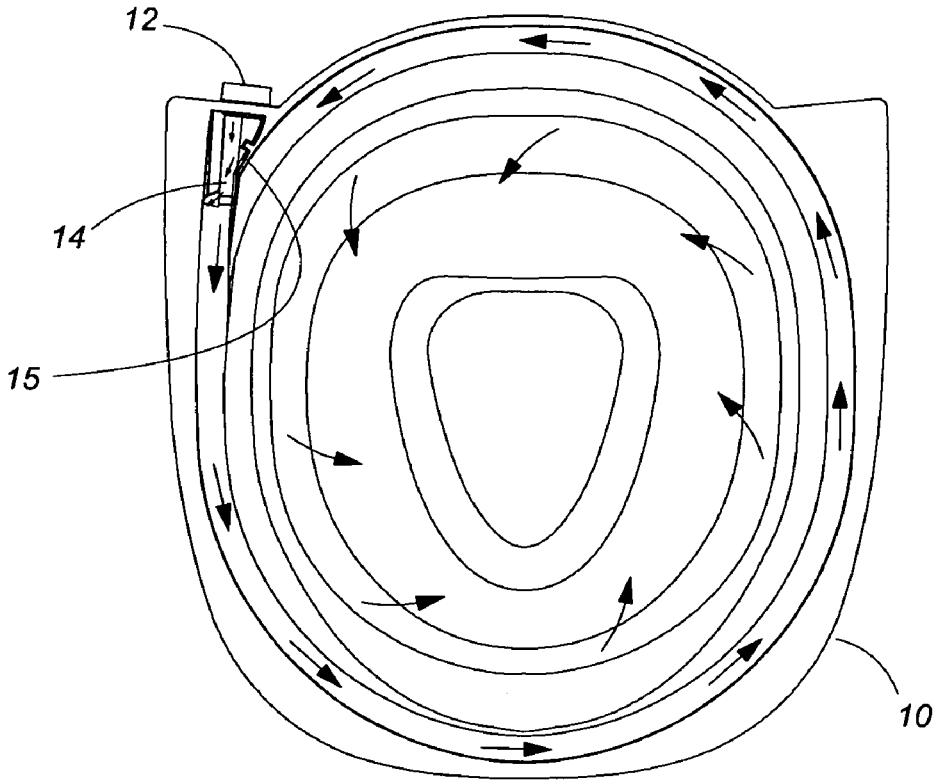
FIG. 6 is an explanatory diagram showing an eddy flow of cleaning water flowing inside the above bowl.

As shown in FIG. 3, the rim 90 is formed at inner circumference of its lower end with a recess portion 91 to be joined to a recess portion 11 formed in inner circumferential surface of upper end of the bowl 10 so as to form a groove, which opens inwardly and extends along the upper perimeter inside the bowl 10. As shown in FIGS. 4 and 5, the flushing port 14 opens into a portion of this groove, and the cleaning water which is expelled from this flushing port 14 flows in an eddy flow to the discharge opening 16 in the lower end of the bowl 10 as indicated by arrows in FIG. 6. As shown in FIG. 4, the flushing port 14 is formed at its vicinity with a guide wall 15, in such a manner that the cleaning water expelled from the flushing port 14 is guided into the groove in front of the flushing port, and thus preventing the cleaning water from flowing straight downwards.

Figure 1:
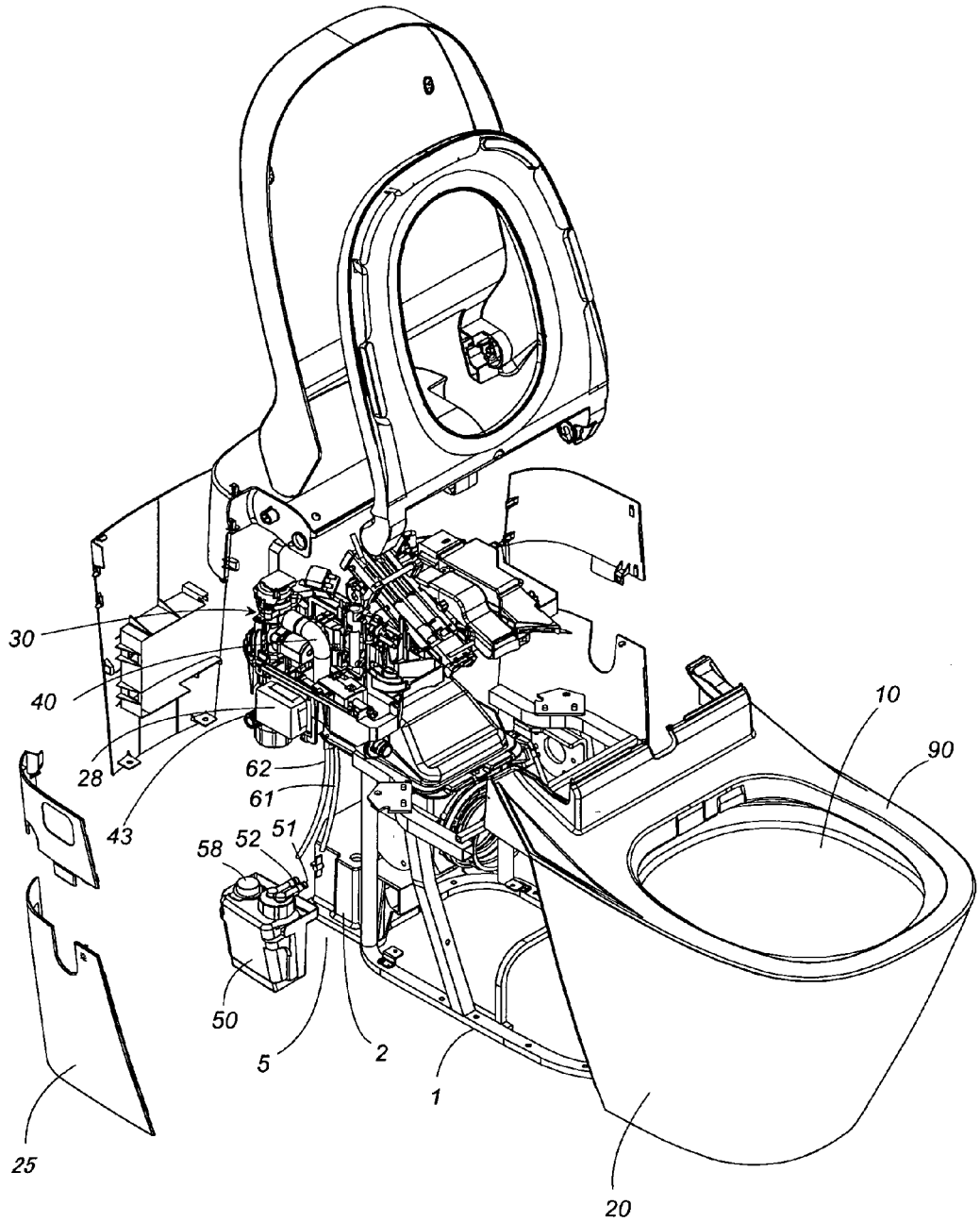
FIG. 1 is an exploded perspective diagram of a toilet apparatus relating to one embodiment of the present invention.
Figure 2:
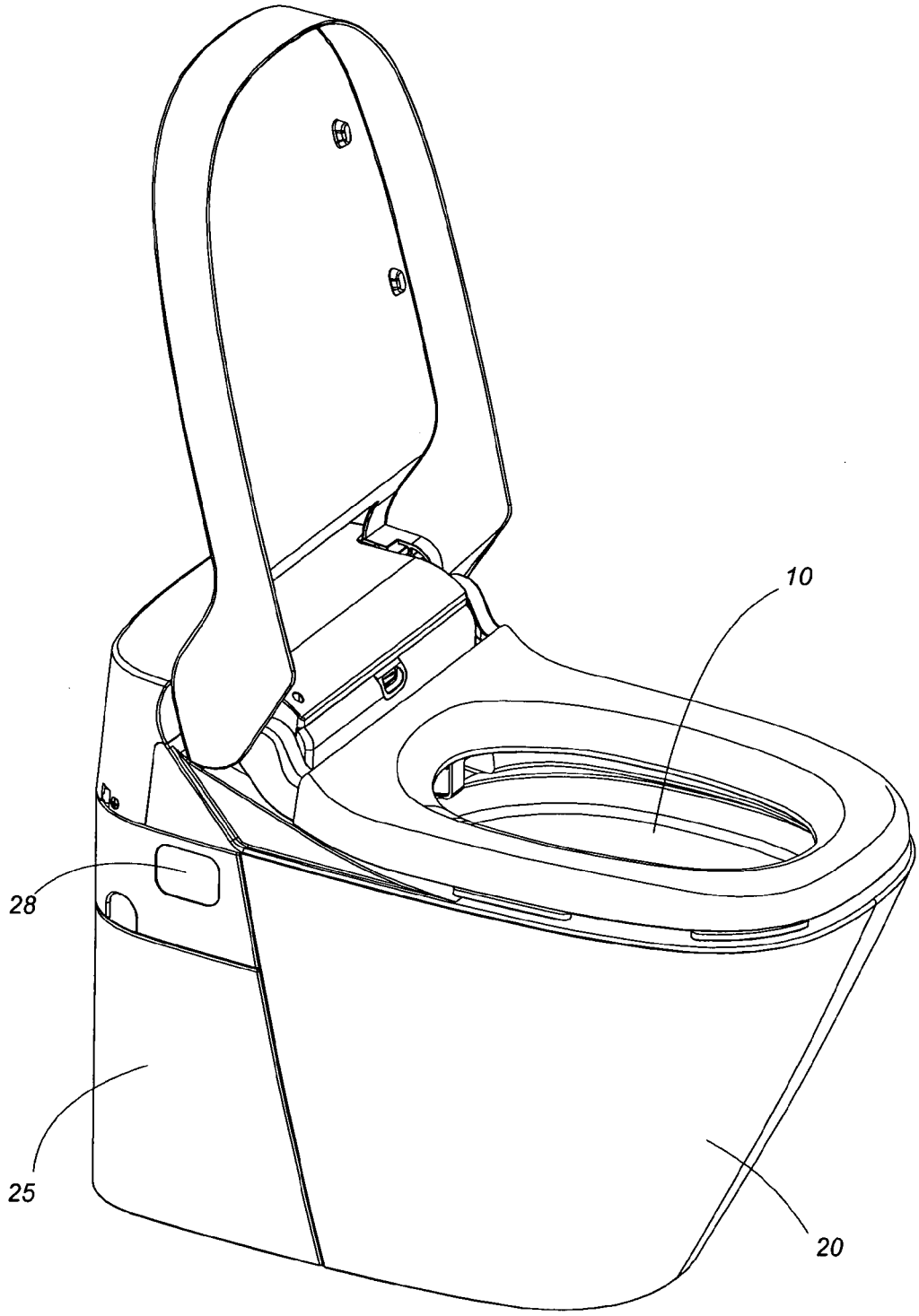
FIG. 2 is a perspective diagram of the above toilet apparatus.

As shown in FIGS. 1 and 7, the bowl cleaning unit 30 comprises a detergent tank 50 storing therein a detergent which is to be mixed with the cleaning water. The cleaning water containing the detergent is flushed into the bowl 10 for cleaning the inner wall of the bowl. The bowl cleaning unit 30 also comprises a detergent supply channel 60 through which the detergent tank 50 is connected to the water supply channel 40. The detergent supply channel 60 is connected to the water supply channel 40 downstream of the electromagnetic valve 35 and upstream of the flushing port 14. As the cleaning water is flushing towards the bowl 10, a negative pressure is developed to suck up the detergent into the water supply channel 40 from the detergent tank 50 via the detergent supply channel 60. Whereby, the detergent merges with the cleaning water into the mixture solution which flows on the inner wall of the bowl as an eddy flow for completely cleaning the inner wall of the bowl 10. For instance, a concentrated neutral detergent may be employed as the detergent.

The detergent supply channel 60 is provided with a pump 65 which is driven in conjunction with the electromagnetic valve 35 to suck up the detergent from the detergent tank 50 for improving efficiency of supplying the detergent to the water supply channel 40. The detergent tank 50 may be provided in a high position inside the housing 20 to reduce a height difference between the detergent tank 50 and the water supply channel 40, so as not to necessitate the pump 65.

The detergent tank 50 is provided in its top surface with a liquid outlet pipe 51 and a liquid return pipe 52 which are respectively connected to a circulation channel 66 which is provided inside the toilet. This circulation channel 66 is connected downstream of a pump 65 to a branching channel 67 through which the circulation channel 66 is connected to the water supply channel 40. The detergent supply channel 60 described above is defined as a path extending through a portion of the circulation channel 66 and the branching channel 67. The pipes 51 and 52 are detachable from the tube which forms the circulation channel 66. The cleaning tank 50 is provided with a lid 58 covering a supply port through which the detergent is supplied. As shown in FIG. 1, this cleaning tank 50 is accommodated in an accommodating space 5 within the housing 20 at the rear end of the toilet, and is installed detachably on a base member 2 which is fixed to the rear end of the supporting frame 1. The outer wall of the housing 20 includes a portion corresponding to the accommodating space 5 for serving as a cover 25, which is designed to be removable from the other portions and conceals the detergent tank 50 therebehind.

Figure 8:
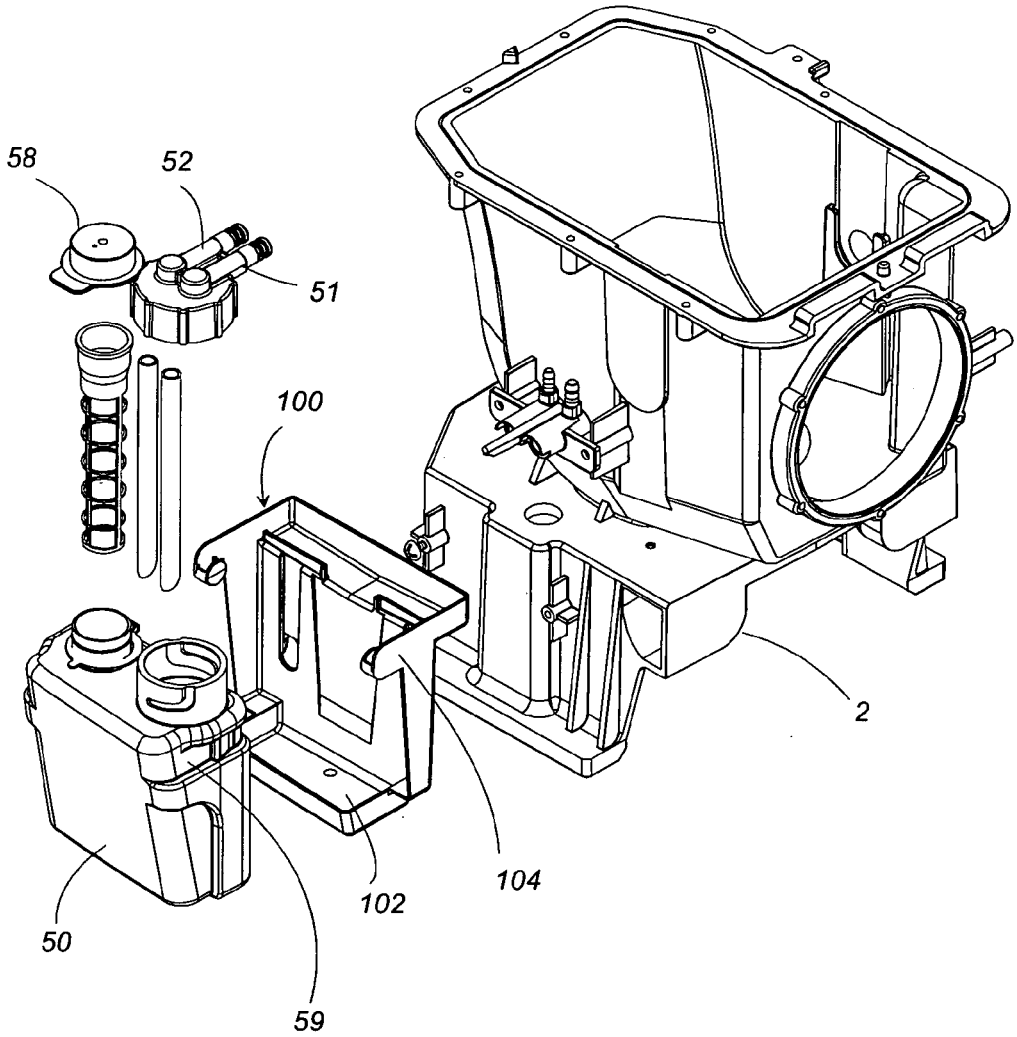
FIG. 8 is an exploded perspective diagram showing the assembly structure of a detergent tank used in the above toilet apparatus.
Figure 9:
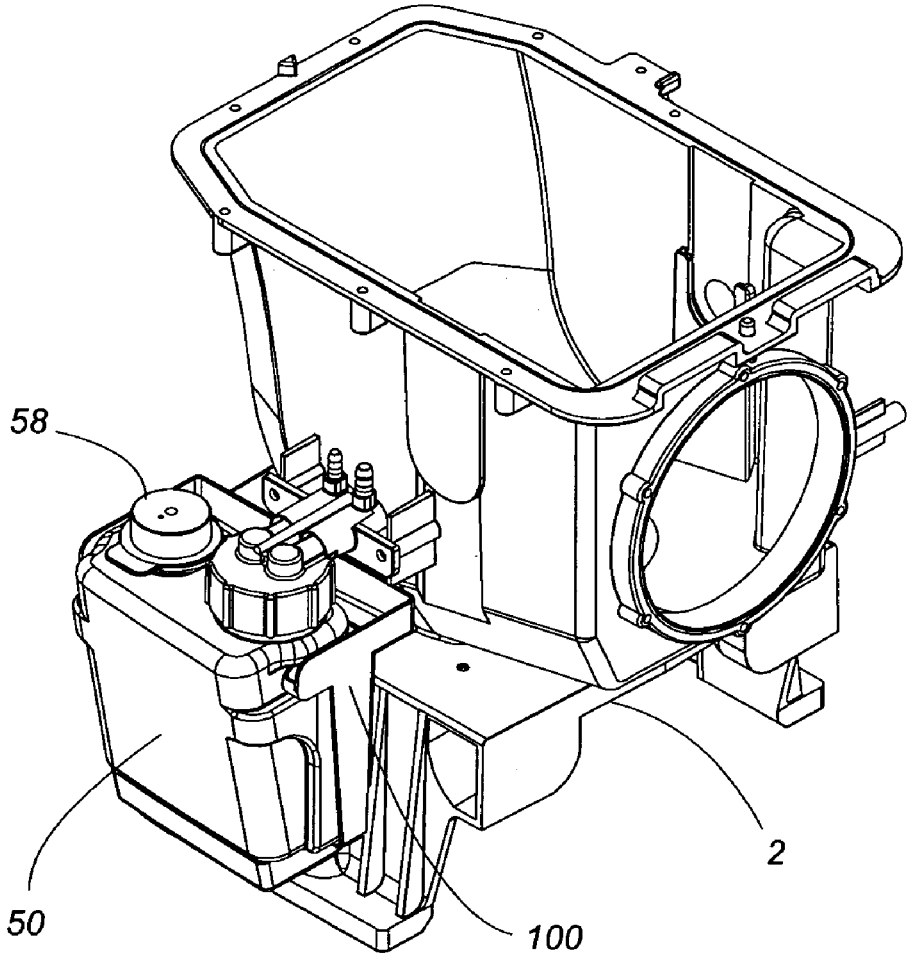
FIG. 9 is a perspective diagram showing the assembly structure of the above detergent tank.

As shown in FIGS. 8 and 9, the detergent tank 50 is arranged to be detachably held by a holder 100 which is installed on the base member 2. The holder 100 comprises a stand 102 on which the detergent tank 50 is installed, and an arm 104 which is slideably coupled to recesses 59 on both sides of the detergent tank 50. For being easily supplied with the detergent, the detergent tank 50 is held on the stand 102 such that its upper end can be tilted outward while its recess 59 is kept in contact with the arm 104. Moreover, the detergent tank 50 can be removed from the holder 100, and the holder 100 is also installed detachably on the base member 2 so as to be removed together with the detergent tank 50 from the base member 2. The base member 2 shown in FIGS. 8 and 9 forms a trap case which is connected to the discharge opening 16 of the bowl 10.

Figure 11:
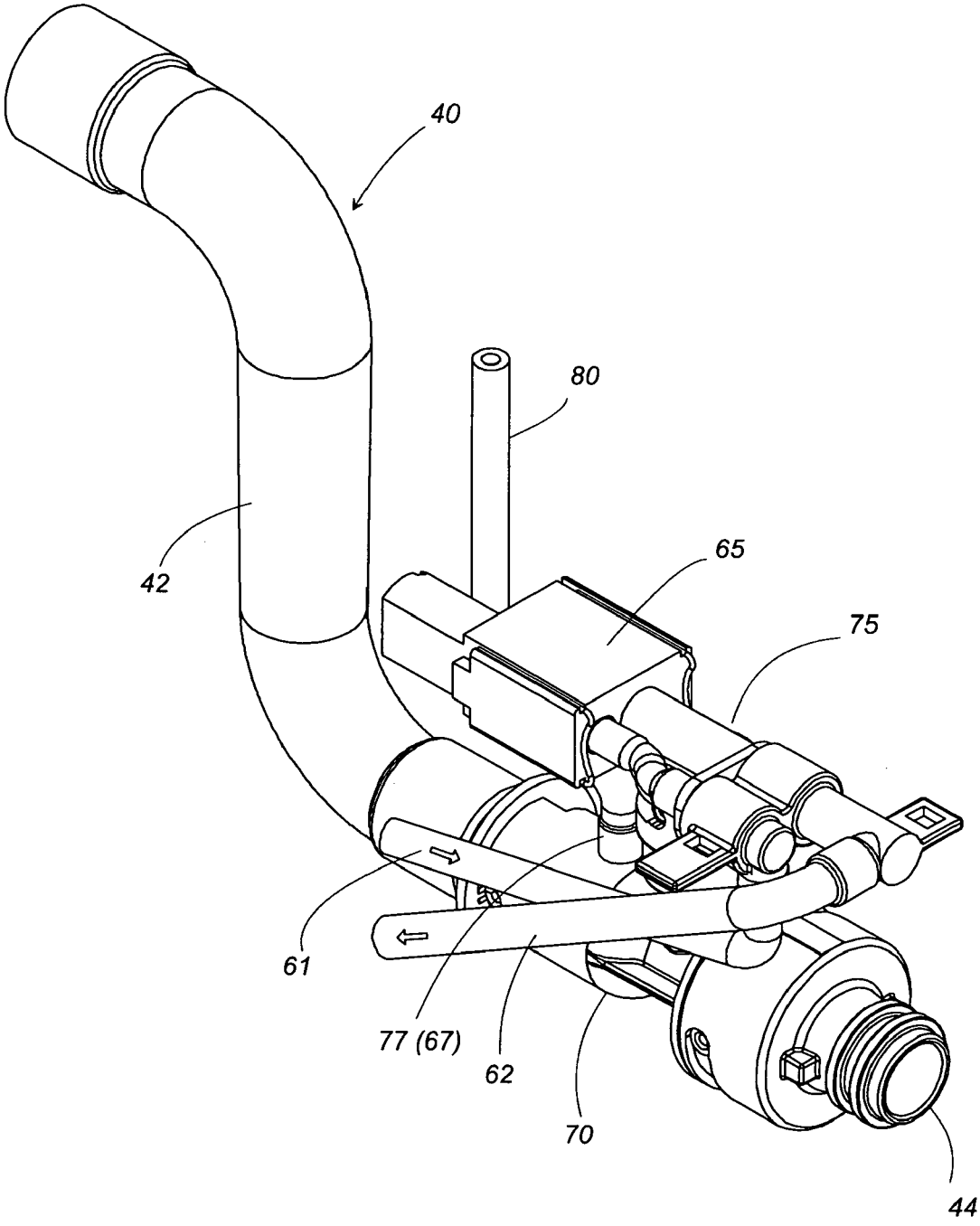
FIG. 11 is a perspective diagram showing one portion of the above bowl cleaning unit.
Figure 12:
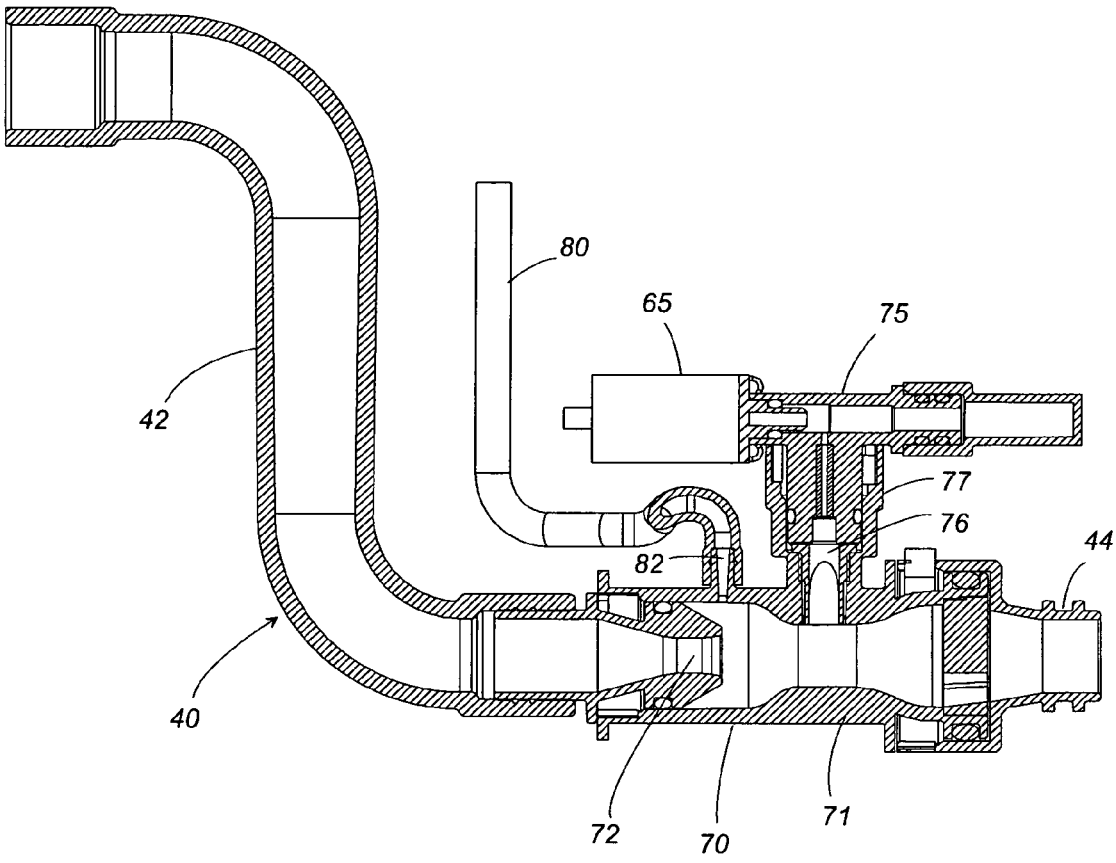
FIG. 12 is a cross-sectional diagram showing one portion of the above bowl cleaning unit.

As shown in FIGS. 10 to 12, the water supply channel 40 comprises a first water supply channel 41 held in a block 6 which is disposed at the upper end of the interior of the housing 20 in the rear portion of the toilet, and a second water supply channel 42 which is connected to this first water supply channel 41. The first water supply channel 41 is formed at its lower end with the water supply port 43. The second water supply channel 42 is provided with a coupling tube 44 coupling to the connection port 12 formed on the bowl 10. The electromagnetic valve 35 is provided in the upper end of the first water supply channel 41 which is coupled to the second water supply channel 42. The second water supply channel 42 is provided at its portion near the coupling tube 44 with a mixer unit 70. The detergent supply channel 60 includes a supply tube 61 and a return flow tube 62 which are respectively coupled to the mixer unit 70 so as to supply the detergent from within the detergent tank 50 into the water supply channel 40. The supply tube 61 is coupled detachably to the liquid outlet pipe 51 of the detergent tank 50, and the return flow tube 62 is coupled detachably to the liquid return pipe 52.

As shown in FIGS. 11 and 12, the mixer unit 70 is composed of a main pipe 71, a branching tube 77 which extends outward from a portion of the main pipe 71 in its radial direction, and a detergent supply head 75 which is connected to the branching tube. The detergent supply head 75 is connected to the supply tube 61 and the return flow tube 62, and provided with the pump 65 so as to circulate the detergent between the detergent tank 50 and the supply head 75 by an action of the pump. This detergent is partially supplied from the branching tube 77 into the main pipe 71 with the help of the negative pressure caused by the flow of cleaning water into the main pipe 71 and the pressure generated by the pump. The branching tube 77 is provided therein with a valve 76 which is driven to open by both the pump pressure and the negative pressure due to the cleaning water. Thereby, the branching channel 67 described above is defined as a path extending from the supply head 75 to the main pipe 71 through the branching tube 77. In order to achieve a strong flow of the cleaning water into the bowl 10 and generate a high negative pressure for being utilized to suck up the detergent into the water supply channel 40, the main pipe 71 is provided with an ejector 72 having a small cross-sectional area of its flow channel.

The main pipe 71 is connected at its portion upstream of the branching tube 77 and downstream of the ejector 72 to an air intake tube 80. The air intake tube 80 introduces external air which is to be dissolved into the cleaning water by the negative pressure due to the flow of cleaning water, so as to generate air bubbles. The bubbles are swiftly flowed downstream to generate fine bubbles in the cleaning water containing the detergent which is flushed into the bowl for improving the cleaning effect. In this way, the air intake tube 80 forms an air injection channel for introducing air into the water supply channel 40, and is provided with a valve 82 at its portion linking to the main pipe 71. The valve 82 is driven to open by the negative pressure due to the cleaning water flowing through the ejector 72, while being kept closed in the absence of the negative pressure.

The bowl cleaning unit 30 is driven by the operating button 28 exposing at the rear portion of the housing 20 to operate in one mode selected from a detergent added cleaning mode in which the pump 65 is urged to work for mixing the detergent with the cleaning water when the electromagnetic valve 35 is opened; and a non-detergent cleaning mode in which the pump 65 is not driven to work when the electromagnetic valve 35 is opened. In either of these modes, air bubbles are contained in the cleaning water. In particular, in the detergent added cleaning mode, the bowl cleaning unit 30 generates very small air bubbles with the help of the detergent so as to improve the effect of the detergent for cleaning the inner walls of the bowl.

The invention claimed is:

1. A toilet apparatus, comprising:

a toilet having a bowl and a housing surrounding said bowl; and a bowl cleaning unit for flushing cleaning water for cleaning the interior of said bowl, wherein said bowl cleaning unit has:

a water supply channel for guiding pressurized cleaning water supplied from an external water supply source into said bowl;

a detergent tank for storing a detergent for removing dirt on inner walls of said bowl;

a detergent supply means for supplying the detergent from said detergent tank into said water supply channel and causing the detergent to mix into the cleaning water;

an electromagnetic valve disposed in said water supply channel; and an air intake tube for introducing external air, wherein said detergent tank is provided in its top surface with a liquid outlet pipe and a liquid return pipe which are respectively connected to a circulation channel which is provided inside the toilet, wherein said detergent supply means has a detergent supply channel through which said detergent tank is connected to said water supply channel, said detergent supply channel being defined as a path extending through a portion of said circulation channel and a branching channel through said circulation channel is connected to said water supply channel, wherein said detergent tank is disposed in a space inside said housing, wherein said water supply channel is formed at its downstream end with a flushing port, wherein said detergent supply channel is connected to said water supply channel downstream of said electromagnetic valve and upstream of said flushing port, and wherein said water supply channel is provided with a mixer unit, said mixer unit being provided with an ejector having a small cross-sectional area of its flow channel in order to generate a high negative pressure for being utilized to suck up the detergent into said water supply channel, and said detergent supply channel is connected to said mixer unit and thereby the detergent is supplied to said water supply channel, and said mixer unit is connected at its portion upstream of said branching channel and downstream of said ejector to said air intake tube and thereby air is supplied to said water supply channel.

2. The toilet apparatus according to claim 1, wherein said detergent tank is detachable from said toilet.

3. The toilet apparatus according to claim 2, wherein said electromagnetic valve controls a flow of the cleaning water in said water supply channel when it is opened, thereby developing a negative pressure for sucking up the detergent from within said detergent tank into said water supply channel through said detergent supply channel, and said liquid outlet pipe and said liquid return pipe of said detergent tank being detachable to a tube forming said detergent supply channel.

4. The toilet apparatus according to claim 2, wherein said detergent supply means comprises a pump which is provided in said detergent supply channel to supply the detergent to said water supply channel, said electromagnetic valve controls a flow of the cleaning water in said water supply channel when it is opened, thereby allowing the detergent to be supplied to the water supply channel from within said detergent tank through said detergent supply channel by the action of said pump, and said liquid outlet pipe and said liquid return pipe of said detergent tank being detachable to a tube forming said detergent supply channel.

5. The toilet apparatus according to claim 1, wherein said a flushing port opens circumferentially along an upper perimeter of said bowl.

6. The toilet apparatus according to claim 1, wherein said water supply channel is connected to an air intake channel for introducing external air.

7. The toilet apparatus according to claim 3, wherein said flushing port opens circumferentially along an upper perimeter of said bowl.

8. The toilet apparatus according to claim 4, wherein said flushing port opens circumferentially along an upper perimeter of said bowl.

9. The toilet apparatus according to claim 1, wherein a portion constituting outer walls of said housing forms a cover that is detachable from other portions of the outer walls to conceal therebehind said detergent tank within said housing.

* * * * *